US010352172B2

(12) United States Patent
Spangler

(10) Patent No.: US 10,352,172 B2
(45) Date of Patent: Jul. 16, 2019

(54) MANUFACTURING METHOD FOR A DUAL WALL COMPONENT

(71) Applicant: United Technologies Corporation, Hartford, CT (US)

(72) Inventor: Brandon W. Spangler, Vernon, CT (US)

(73) Assignee: United Technologies Corporation, Farmington, CT (US)

( * ) Notice: Subject to any disclaimer, the term of this patent is extended or adjusted under 35 U.S.C. 154(b) by 652 days.

(21) Appl. No.: 14/914,304

(22) PCT Filed: Sep. 2, 2014

(86) PCT No.: PCT/US2014/053674

§ 371 (c)(1),
(2) Date: Feb. 25, 2016

(87) PCT Pub. No.: WO2015/034815

PCT Pub. Date: Mar. 12, 2015

(65) Prior Publication Data

US 2016/0222790 A1 Aug. 4, 2016

Related U.S. Application Data

(60) Provisional application No. 61/874,488, filed on Sep. 6, 2013.

(51) Int. Cl.
*F01D 5/14* (2006.01)
*F01D 5/18* (2006.01)
(Continued)

(52) U.S. Cl.
CPC ..... *F01D 5/147* (2013.01); *F01D 5/18* (2013.01); *F01D 5/187* (2013.01); *F01D 9/041* (2013.01);
(Continued)

(58) Field of Classification Search
CPC ..... F01D 5/147; F01D 11/08; F01D 9/041; F01D 5/18; F01D 5/187;
(Continued)

(56) References Cited

U.S. PATENT DOCUMENTS 2,302,229 A * 11/1942 Lampton ..... B21D 53/78 148/521
5,348,446 A * 9/1994 Lee ..... C30B 11/002 29/889.72
(Continued)

FOREIGN PATENT DOCUMENTS

WO 9906672 A1 2/1999

OTHER PUBLICATIONS

Extended European Search Report, for European Patent Application No. 14841618.3, dated May 4, 2017, 6 pages.
(Continued)

*Primary Examiner* — Jacob J Cigna
*Assistant Examiner* — Lee A Holly
(74) *Attorney, Agent, or Firm* — Kinney & Lange, P.A.

(57) ABSTRACT

A dual wall component includes a first outer wall extending from a leading edge to a trailing edge, a first inner wall spaced from the first outer wall by a plurality of first cavities and first ribs, a second inner wall spaced from the first inner wall by a plurality of second cavities and second ribs, and a second outer wall extending from the leading edge to the trailing edge and spaced from the second inner wall by a plurality of third cavities and third ribs. Portions of the first and second outer walls have thicknesses less than about 0.018" (0.457 mm). In a method for forming a dual wall component, component walls are formed by additive manufacturing and without using cores to form the cavities.

20 Claims, 6 Drawing Sheets

(51) Int. Cl.
*F01D 9/04* (2006.01)
*F01D 11/08* (2006.01)

(52) U.S. Cl.
CPC ..... *F01D 11/08* (2013.01); *F05D 2220/32* (2013.01); *F05D 2230/30* (2013.01); *F05D 2260/204* (2013.01); *F05D 2260/22141* (2013.01); *F05D 2300/606* (2013.01)

(58) Field of Classification Search
CPC ..... F05D 2260/22141; F05D 2260/204; F05D 2230/30; F05D 2220/32; F05D 23/606; C22C 32/00; B22F 3/1055; B23P 15/00; B23P 15/04
See application file for complete search history.

(56) References Cited

U.S. PATENT DOCUMENTS 5,626,462 A * 5/1997 Jackson ..... C22C 32/00 416/229 A
6,582,194 B1 * 6/2003 Birkner ..... B23P 15/04 415/115
8,375,699 B1 * 2/2013 Atassi ..... F02K 1/48 60/226.3
2005/0091848 A1 5/2005 Nenov et al.
2007/0048128 A1 * 3/2007 Cunha ..... B23P 15/00 415/170.1
2007/0128031 A1 6/2007 Liang
2008/0290215 A1 11/2008 Udall et al.
2011/0097213 A1 4/2011 Peretti et al.
2011/0311389 A1 12/2011 Ryan et al.
2012/0266439 A1 * 10/2012 Geiger ..... B22F 3/1055 29/428
2013/0001837 A1 1/2013 Gohler et al.

OTHER PUBLICATIONS

International Searching Authority, PCT Notification of Transmittal of the International Search Report and the Written Opinion, dated Dec. 10, 2014, 14 pages.

* cited by examiner

MANUFACTURING METHOD FOR A DUAL WALL COMPONENT

BACKGROUND

The high temperatures of gases and components within gas turbine engines require advanced cooling solutions. In the "hot sections" of a gas turbine engine, the walls of some components can be exposed to gases having temperatures above the melting point of the material used to form the walls. As a result, the walls of such components can contain a number of cavities through which cooling air flows to reduce component temperature.

Dual wall gas turbine engine components offer improved cooling compared to single wall components. For example, a single wall airfoil typically includes a pair of outer walls spaced from one another by a main cavity (or set of cavities). Cooling air flows through the main cavity to cool the inner surfaces of the outer walls and/or to facilitate impingement cooling of the airfoil. Typically, dual wall components include both outer and inner walls. One cavity (sometimes referred to as a "skin cavity") is positioned between an outer wall and an inner wall and another cavity (a central cavity) is positioned between the inner wall and another inner or outer wall. Cooling air flows through the central cavity to cool the inner surfaces of the inner wall and/or to facilitate impingement cooling of the airfoil. Cooling air flows through the skin cavity to cool the inner surfaces of the inner wall and outer wall and/or to facilitate impingement cooling of the airfoil.

While dual wall components offer the potential for improved cooling, these components are generally difficult and expensive to manufacture. Currently, dual wall components are generally cast using ceramic cores and/or refractory metal cores (RMCs). Investment casting is generally used to form dual wall components, in which one or more ceramic cores are used to form the central cavity or cavities and either ceramic cores or RMCs are used to form the skin cavities. The use of ceramic and RMCs offer disadvantages due to core deformation. As a result of core deformation, greater design tolerances must be built in to the manufacture of dual wall components.

SUMMARY

A dual wall component includes a first outer wall extending from a leading edge to a trailing edge, a first inner wall spaced from the first outer wall by a plurality of first cavities and first ribs, a second inner wall spaced from the first inner wall by a plurality of second cavities and second ribs, and a second outer wall extending from the leading edge to the trailing edge and spaced from the second inner wall by a plurality of third cavities and third ribs. Portions of the first and second outer walls have thicknesses less than about 0.018" (0.457 mm).

A method for forming a dual wall component includes forming an outer wall, forming an inner wall and forming a third wall. The inner wall and the outer wall are separated by a first cavity, and the third wall and the inner wall are separated by a second cavity. The outer wall, the inner wall and the third wall are formed by additive manufacturing and without using cores to form the first and second cavities.

A method for forming a blade extending from a root to a tip includes forming a pressure side outer wall extending from a leading edge to a trailing edge, forming a suction side outer wall extending from the leading edge to the trailing edge, forming a first inner wall having a shape complimentary to the pressure side outer wall, and forming a second inner wall having a shape complimentary to the suction side outer wall. The first inner wall and the pressure side outer wall are separated by a first cavity, the second inner wall and the suction side outer wall are separated by a second cavity, and the second inner wall and the first inner wall are separated by a third cavity. The pressure side outer wall, the suction side outer wall, the first inner wall and the second inner wall are formed by additive manufacturing and without using cores to form the first, second and third cavities.

DETAILED DESCRIPTION

According to the present invention, dual wall components are formed by additive manufacturing. The ceramic cores and refractory metal cores (RMCs) used in current investment casting methods are not needed. By removing ceramic cores and RMCs from the manufacturing process, the wall thickness of dual wall components can be reduced in turn reducing both manufacturing costs and component weight.

Figure 1:
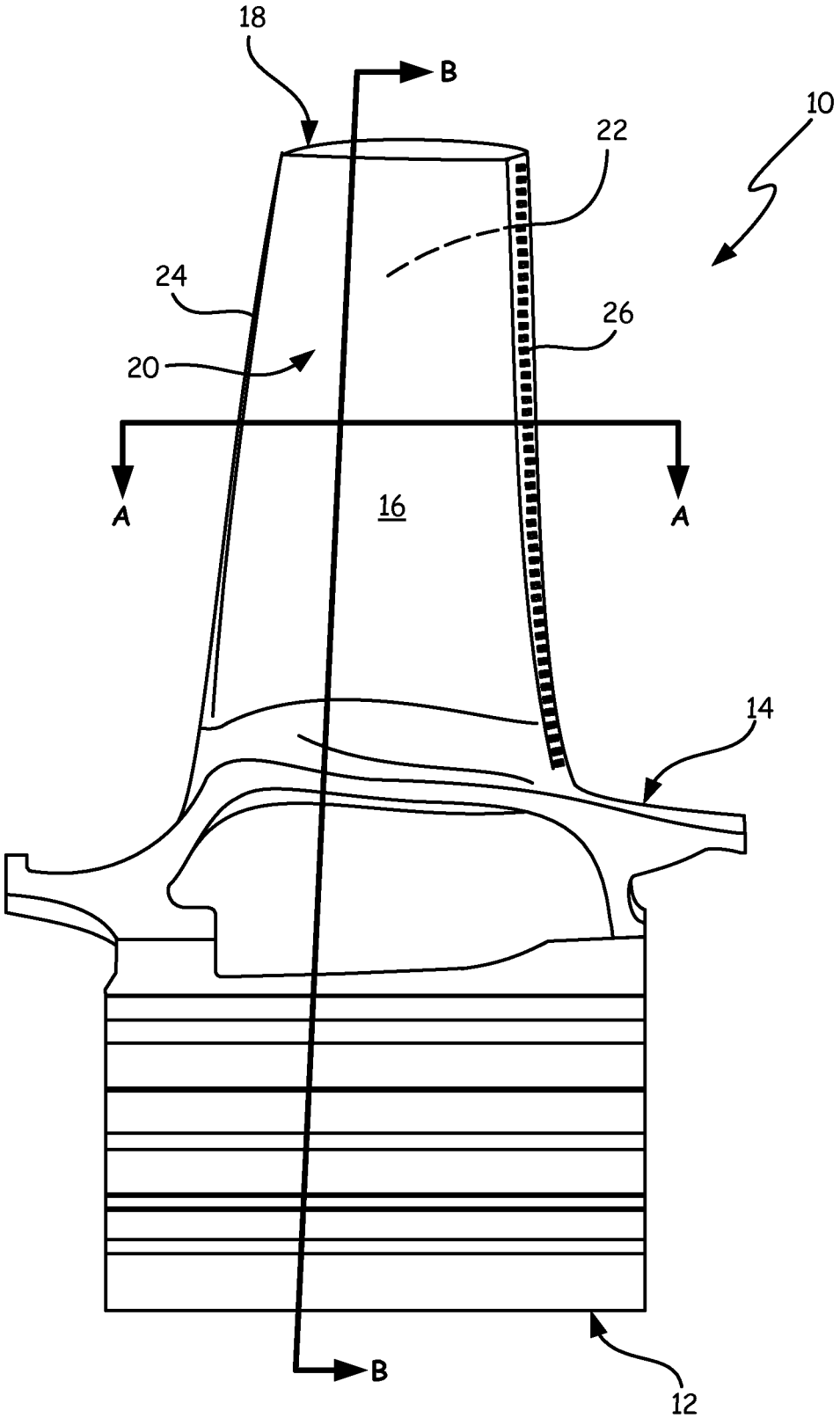
FIG. 1 is a side view of a blade.

Dual wall components can offer improved cooling capabilities compared to simpler, single wall structures. Examples of components that can have dual walls include, but are not limited to, blades, vanes, and blade outer air seals (BOAS). The features of a blade will be used to describe one example of a dual wall component formed according to the present invention. FIG. 1 is a side view of a dual wall blade. Blade 10 includes root section 12, platform 14, airfoil 16 and tip section 18. Blade 10 extends from root section 12 to tip section 18 along a radial axis. Airfoil 16 extends radially from platform 14. Airfoil 16 includes pressure side wall 20 and suction side wall 22, which extend from leading edge 24 to trailing edge 26.

Figure 2:
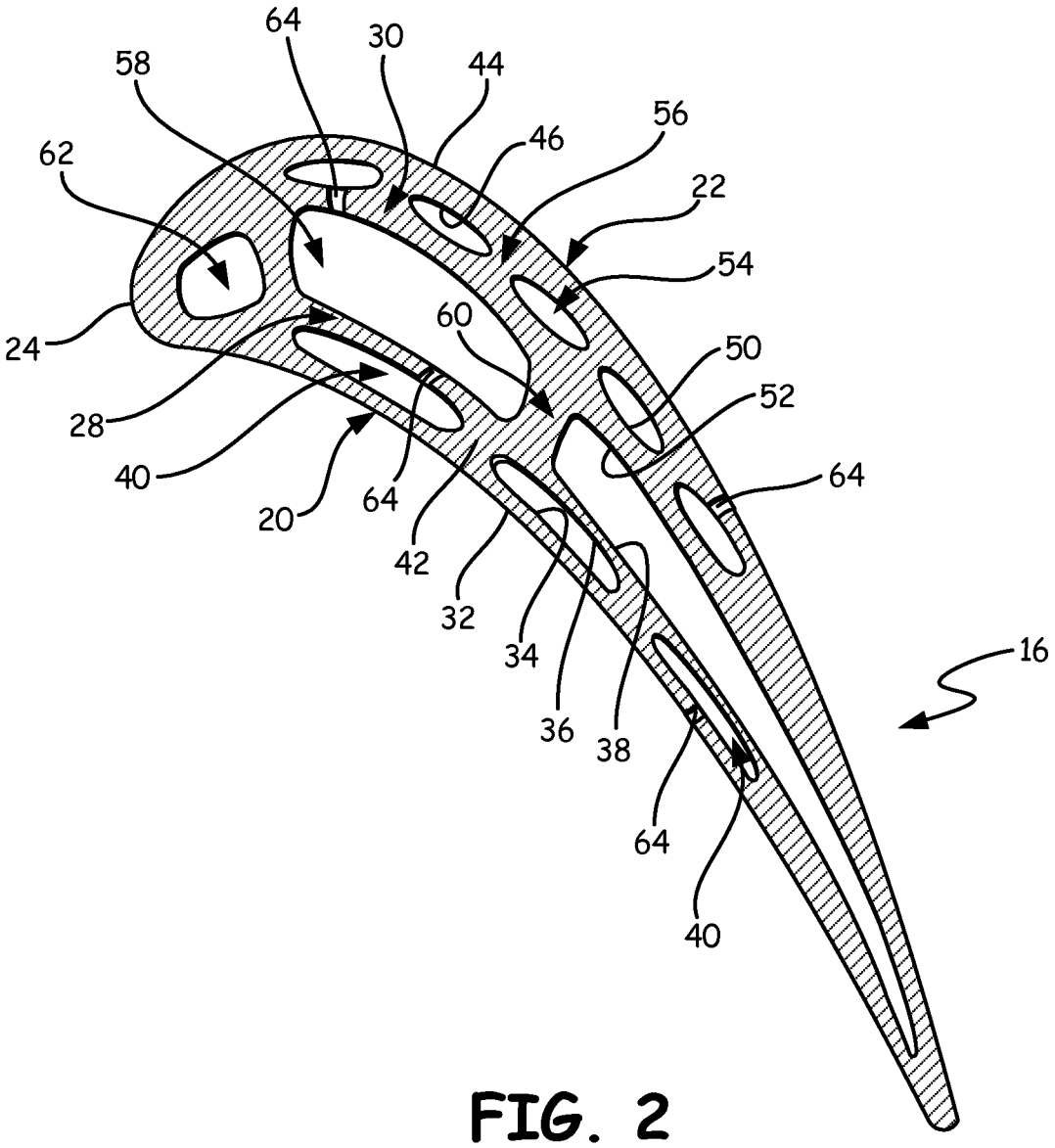
FIG. 2 is a cross section view of the blade of FIG. 1 taken along the line A-A.

FIG. 2 is a cross section view of blade 10 of FIG. 1 taken along the line A-A and illustrates the dual walls of airfoil 16. Pressure side wall 20 forms a first outer wall, and suction side wall 22 forms a second outer wall, the two walls meeting at leading edge 24. Airfoil 16 also includes first inner wall 28 and second inner wall 30. As shown in FIG. 2, pressure side wall 20 extends between outer surface 32 and inner surface 34. First inner wall 28 has a generally complimentary shape to pressure side wall 20 and extends between outer surface 36 and inner surface 38. One or more cavities 40 separate pressure side wall 20 and first inner wall 28. In the embodiment shown in FIG. 2, three cavities 40 are present between pressure side wall 20 and first inner wall 28. Cavities 40 are separated from one another by ribs 42. Ribs 42 extend from pressure side wall 20 to first inner wall 28. Each cavity 40 is defined by inner surface 34 of pressure side wall 20, outer surface 36 of first inner wall 28 and ribs 42.

Suction side wall 22 extends between outer surface 44 and inner surface 46. Second inner wall 30 has a generally complimentary shape to suction side wall 22 and extends between outer surface 50 and inner surface 52. One or more cavities 54 separate suction side wall 22 and second inner wall 30 in the same way that cavities 40 separate pressure side wall 20 and first inner wall 28. In the embodiment shown in FIG. 2, five cavities 54 are present between suction side wall 22 and second inner wall 30. Cavities 54 are separated from one another by ribs 56. Ribs 56 extend from suction side wall 22 to second inner wall 30. Each cavity 54 is defined by inner surface 46 of suction side wall 22, outer surface 50 of second inner wall 30 and ribs 56. Cavities 40 and 54 are sometimes referred to as "skin cavities" as they are cavities located near the skin (outer wall) of the airfoil. In some embodiments, passages 64 are formed in pressure side wall 20 so that cooling air can flow from cavities 40 and form a cooling film along outer surface 32 of pressure side wall 20. Likewise, passages 64 can be formed in suction side wall 22 so that cooling air can flow from cavities 54 and form a cooling film along outer surface 44 of suction side wall 22.

In addition to skin cavities 40 and 54, airfoil 16 also includes one or more central cavities 58. Central cavities 58 are located between first inner wall 28 and second inner wall 30. Central cavities 58 are separated from one another by central ribs 60. Central ribs 60 extend from first inner wall 28 to second inner wall 30. Each central cavity 58 is defined by inner surface 38 of first inner wall 28, inner surface 52 of second inner wall 30 and central ribs 60. In some embodiments, passages 64 are formed in first inner wall 28 and/or second inner wall 30 so that cooling air can flow from central cavities 58 to cavities 40 and/or 54, respectively. In some embodiments, airfoil 16 also includes leading edge cavity 62. As shown in FIG. 2, leading edge cavity 62 can be formed upstream of first inner wall 28 and second inner wall 30. Blade 10 can also include passages 64 that extend between two nearby cavities or extend from cavity 40 through pressure side wall 20 or from cavity 54 through suction side wall 22. Passages 64 allow cooling air to flow between cavities of blade 10 or provide for the formation of a film of cooling air along pressure side wall 20 or suction side wall 22.

Dual wall components according to the present invention, such as airfoil 16 of blade 10, can include two sets of inner and outer walls as shown in the embodiment illustrated in FIG. 2. Alternatively, other embodiments of dual wall components include one set of inner and outer walls and another single outer wall. These alternative embodiments contain skin cavities (cavities 40, 54) only on one side of the component (the side with dual walls).

To date, dual wall components, such as airfoil 16 shown in FIG. 2, have typically been manufactured using investment casting. During investment casting, ceramic cores and RMCs are used to define the cavities and the shapes of some features of the component. For example, ceramic cores are often used to form central cavities 58 and leading edge cavity 62, while ceramic cores or RMCs are often used to form skin cavities 40 and 54 and cooling passages that extend from cavities 40 and 54 through pressure side wall 20 and suction side wall 22, respectively.

The use of ceramic cores and RMCs in the manufacturing process of dual wall components has some disadvantages. Both ceramic cores and RMCs can warp or deform during formation or during the investment casting process. For example, RMCs have a tendency to warp during their formation. The high temperatures used during the creation of RMCs can cause some areas of the core to warp and bend undesirably. Additionally, the investment casting process can cause ceramic cores to warp, deform or deflect from their original shape. Ceramic core deformation during casting is generally unpredictable. While the shape change of a specific RMC can be somewhat compensated for in the design of a component (i.e. a design could be built around a warped RMC), the unpredictable nature of ceramic core deformation combined with RMC warping requires a relatively large tolerance in design, particularly wall thickness.

Figure 3A:
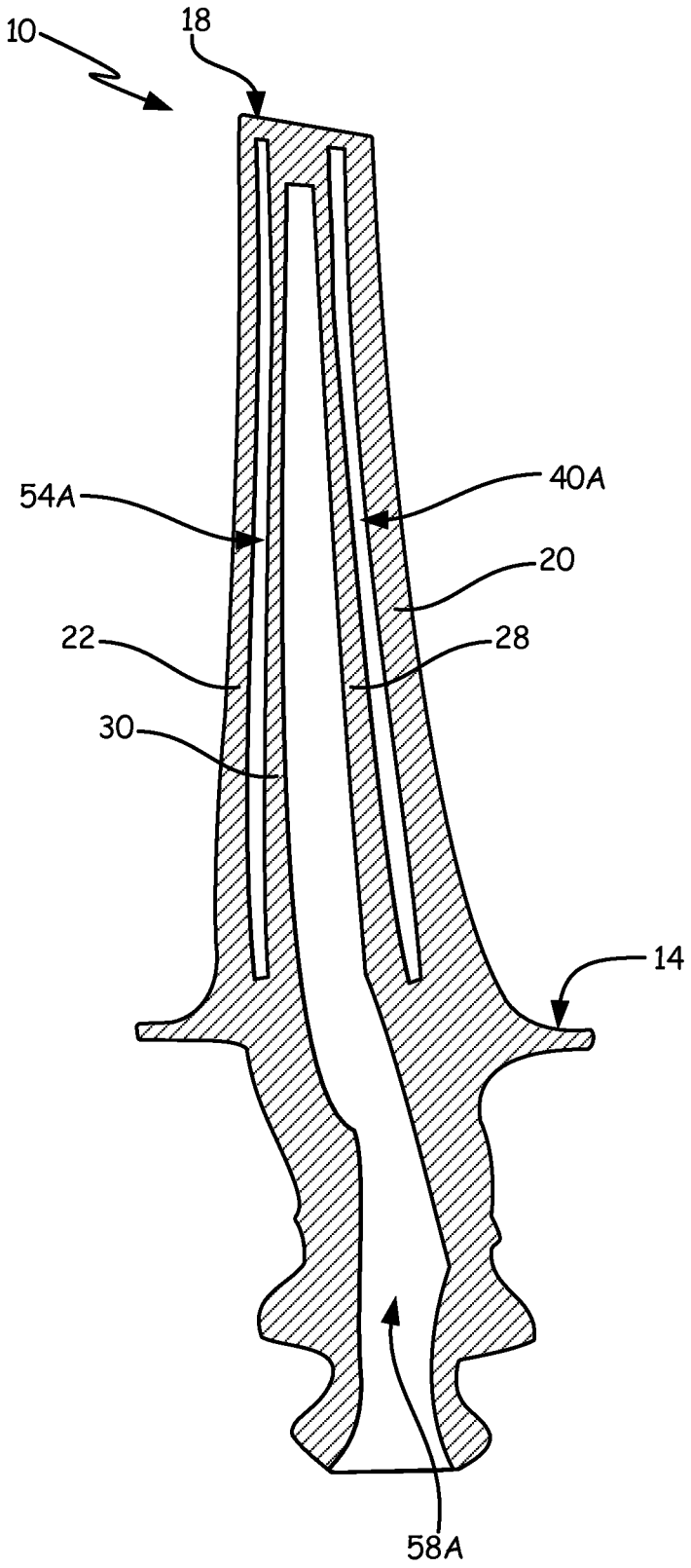
FIG. 3A is a cross section view of a blade manufactured with ceramic and refractory metal cores taken along the line B-B shown in FIG. 1.
Figure 3B:
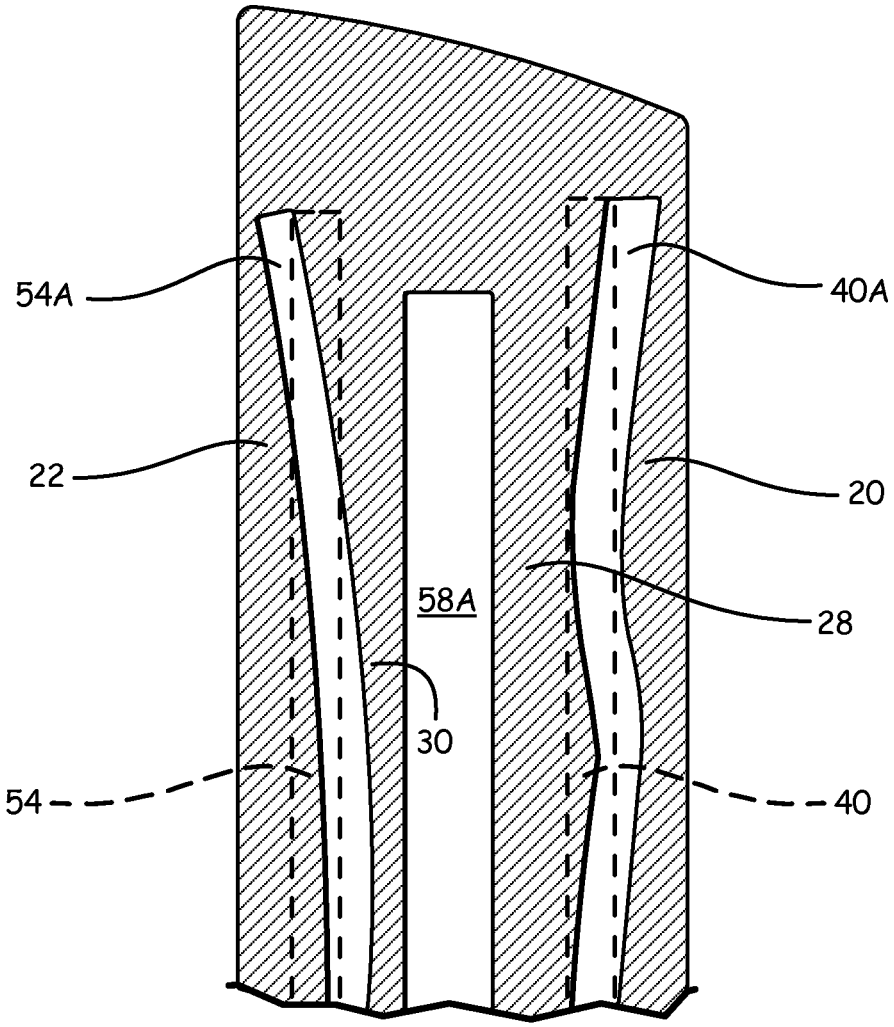
FIG. 3B is an enlarged section view of the tip region of the blade shown in FIG. 3A.

FIGS. 3A and 3B demonstrate a blade formed with a ceramic core and RMCs. FIG. 3A is a cross section view of a blade taken along the line B-B shown in FIG. 1, and FIG. 3B is an enlarged section view of the tip region of the blade shown in FIG. 3A. FIG. 3A illustrates central cavity 58A and cavities 40A and 54A. FIG. 3B illustrates the difference between the design intent positions of cavities 40 and 54 (shown as dashed lines 40 and 54, respectively) and the actual positions of cavities 40A and 54A when formed with warped ceramic cores or RMCs. Due to the difference between the actual positions of cavities 40A and 54A within airfoil 16 and design intent positions 40 and 54, the thicknesses of walls 20, 22, 28 and 30 must be increased to compensate for warping. Without this additional compensation, one or more of walls 20, 22, 28 and 30 may be formed too thin or the RMC (or casting features used to position the RMC relative to the ceramic core) may breach the wall, creating undesired crossover between cavities or between a cavity and the external airfoil surface, which can result in unwanted air leakage within blade 10. Additionally, FIG. 3B does not take into account a central cavity 58 formed by a ceramic core deformed during investment casting. Any deformation of the ceramic core used to form central cavity 58 could increase the likelihood of a thin wall or undesired crossover. Typical compensation requires pressure side wall 20, suction side wall 22, first inner wall 28 and second inner wall 30 to have thicknesses of at least about 0.023" (0.584 mm) near tip section 18 of blade 10. Near root section 12 and platform 14, pressure side wall 20, suction side wall 22, first inner wall 28 and second inner wall 30 can have thicknesses of at least about 0.060" (1.52 mm). Airfoil 16 is thicker near root section 12 and platform 14 than tip section 18 due to the forces exerted on airfoil 16 closer to the blade root.

Forming blade 10 using additive manufacturing removes the need for the increased tolerances required when forming blade 10 using ceramic cores and RMCs. According to the present invention, blade 10 (and other dual wall components) is formed using additive manufacturing and without the use of ceramic cores or RMCs. Pressure side wall 20; suction side wall 22; first inner wall 28; second inner wall 30; and ribs 42, 56 and 60 of blade 10 are formed using additive manufacturing. In additive manufacturing, a three-dimensional computer model of blade 10 is formed and "sliced" into layers. Material is then added layer by layer to form blade 10. In some embodiments, blade 10 is formed starting at root section 12 or platform 14 and built layer by layer to tip section 18.

Various additive manufacturing techniques can be used to form walls 20, 22, 28, 30 and ribs 42, 56 and 60. In one embodiment, direct metal laser sintering is the additive manufacturing technique used to form the walls and ribs of blade 10. Direct metal laser sintering is an additive metal fabrication process often used with metal alloys. A layer of metal powder is positioned on a substrate or preceding metal layer according to the three-dimensional computer model of the part. A high-powered laser is then used to locally melt the layer of metal powder. This process of adding a layer of metal powder and locally melting the layer is repeated until the part is complete. In another embodiment, electron beam melting is the additive manufacturing technique used to form the walls and ribs of blade 10. Electron beam melting is similar to direct metal laser sintering, but possesses some differences. Electron beam melting is often used with titanium alloys and instead of melting the material with a laser, an electron beam in a high vacuum is used to melt each metal powder layer.

Walls 20, 22, 28, 30 and ribs 42, 56 and 60 can be formed of the same or different materials. Manufacturing walls 20, 22, 28, 30 and ribs 42, 56 and 60 with the same material simplifies the manufacturing process. In one embodiment, walls 20, 22, 28, 30 and ribs 42, 56 and 60 are formed of a directionally solidified material. Directionally solidified materials possess grains that have been grown in a particular direction. The grain boundaries (defects in the crystal or crystallite structure) of directionally solidified materials extend predominantly in a single direction. Suitable directionally solidified materials include, but are not limited to, nickel, cobalt and titanium. In another embodiment, walls 20, 22, 28, 30 and ribs 42, 56 and 60 are formed of an equiaxed material. For equiaxed materials, the grains or crystals that make up the material have roughly the same properties in all directions (e.g., axes of approximately the same length). The grain boundaries of equiaxed materials can extend in multiple directions. Suitable equiaxed materials include, but are not limited to, nickel, cobalt and titanium.

Figure 4A:
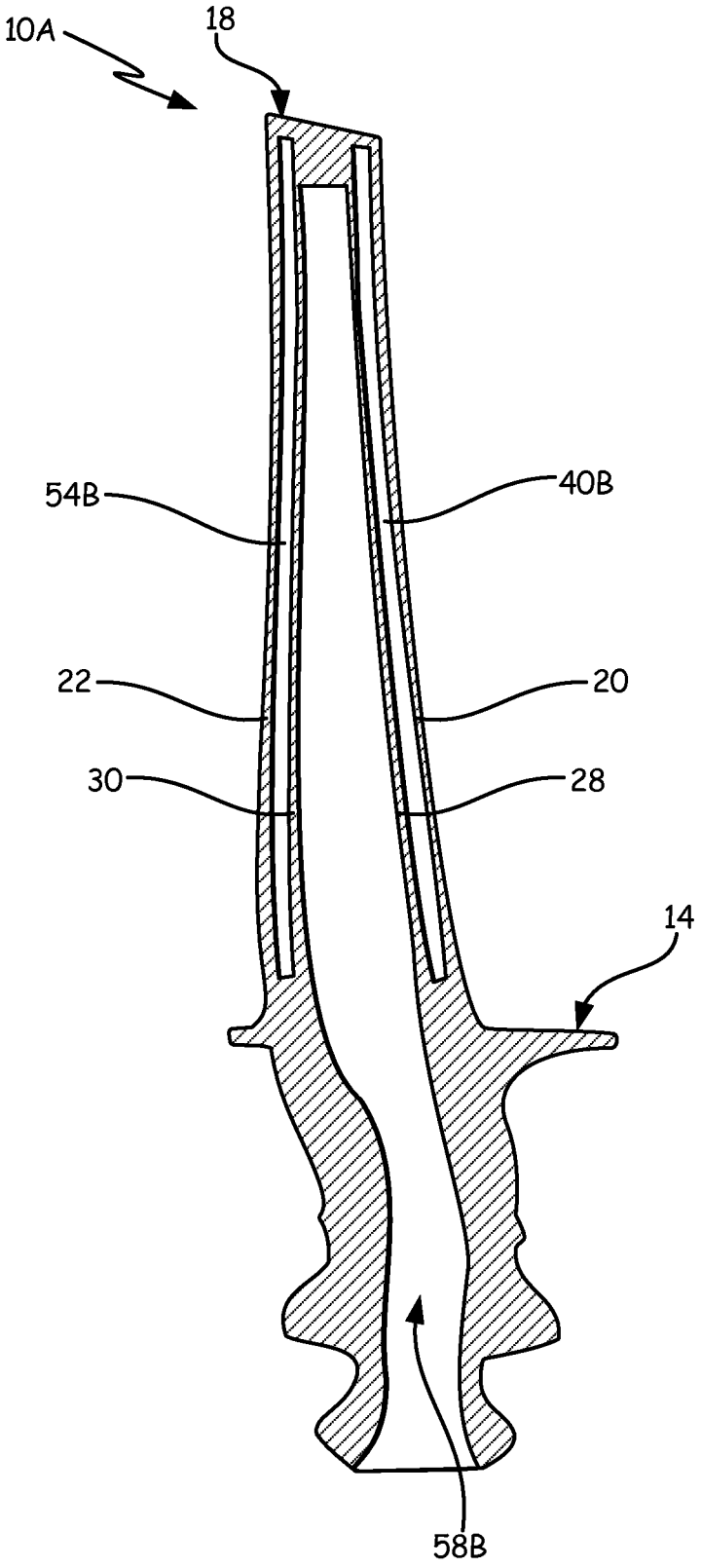
FIG. 4A is a cross section view of a blade produced using additive manufacturing taken along the line B-B shown in FIG. 1.
Figure 4B:
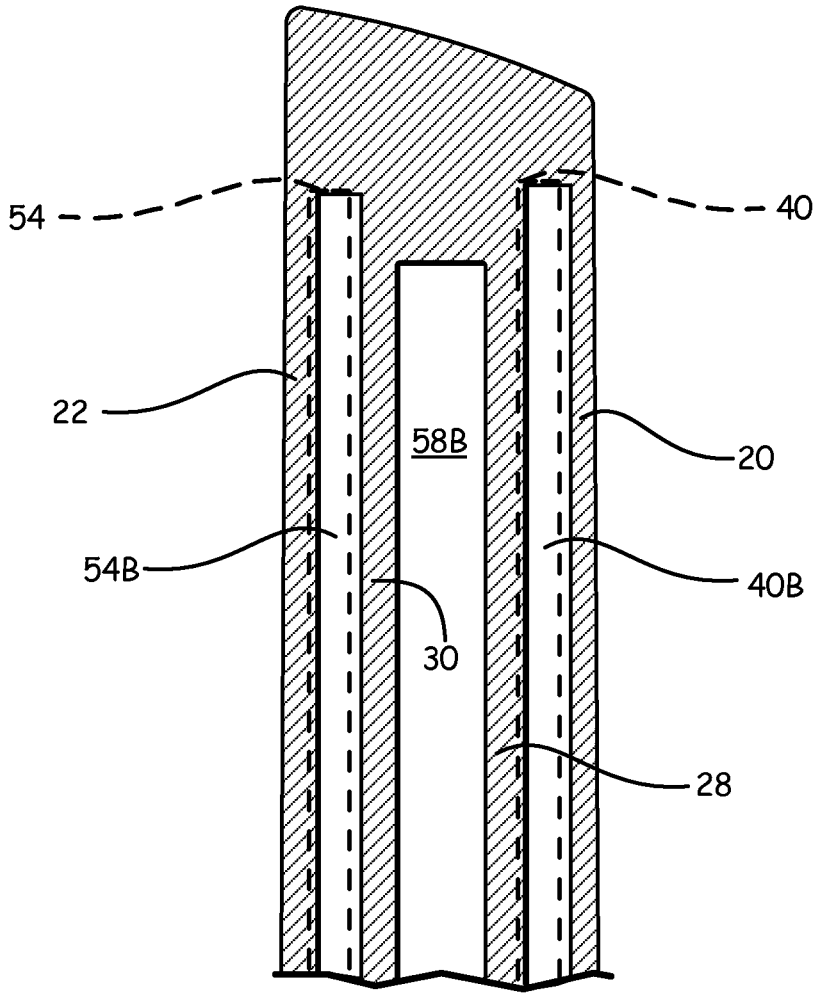
FIG. 4B is an enlarged section view of the tip region of the blade shown in FIG. 4A.

FIGS. 4A and 4B demonstrate a blade formed using additive manufacturing. FIG. 4A is a cross section view of blade 10A taken along the line B-B shown in FIG. 1, and FIG. 4B is an enlarged section view of the tip region of blade 10A shown in FIG. 4. Like FIG. 3A, FIG. 4A illustrates central cavity 58B and cavities 40B and 54B. FIG. 4B illustrates the difference between the design intent positions of cavities 40B and 54B (shown as dashed lines 40 and 54, respectively) and the actual positions of cavities 40B and 54B when formed using additive manufacturing. Unlike the cavities formed using warped RMCs, cavities 40 and 54 are much closer to the design intent positions 40B and 54B. Thus, the thicknesses of walls 20, 22, 28 and 30 do not need to be increased to the extent done when blade 10 is manufactured using ceramic cores and RMCs. This allows walls 20, 22, 28 and 30 to be made thinner, providing a comparative weight reduction to blade 10. Additionally, because a ceramic core is not used to form central cavity 58, no deformation of the ceramic core needs to be taken into account. Additive manufacturing allows pressure side wall 20, suction side wall 22, first inner wall 28 and second inner wall 30 to have thicknesses of less than about 0.018" (0.457 mm) and as low as about 0.015" (0.381 mm) near tip section 18 of blade 10. Near root section 12 and platform 14, pressure side wall 20, suction side wall 22, first inner wall 28 and second inner wall 30 can have thicknesses less than about 0.050" (1.27 mm) and as low as about 0.040" (1.02 mm).

In some embodiments, passages 64 in blade 10 are formed during the additive manufacturing process (i.e. material is not added in the regions where passages 64 are formed). In other embodiments, passages 64 are drilled after blade 10 has been formed.

The above description illustrates the formation of blade 10 using additive manufacturing. Other dual wall components, such as vanes and BOASs, can be formed using additive manufacturing in a similar fashion.

By forming dual wall components using additive manufacturing, wall thicknesses for the component can be reduced when compared to dual wall components formed using ceramic cores and RMCs. Reducing wall thickness provides a corresponding reduction in the weight of the component. In some cases, the weight of a dual wall component can be reduced by as much as 10%. Forming dual wall components using additive manufacturing also greatly reduces the likelihood of unintended crossovers and resulting air leakage sometimes observed when dual wall components are formed using ceramic cores and RMCs.

Discussion of Possible Embodiments

The following are non-exclusive descriptions of possible embodiments of the present invention.

A dual wall component can include a first outer wall extending from a leading edge to a trailing edge, a first inner wall spaced from the first outer wall by a plurality of first cavities and first ribs, a second inner wall spaced from the first inner wall by a plurality of second cavities and second ribs, and a second outer wall extending from the leading edge to the trailing edge and spaced from the second inner wall by a plurality of third cavities and third ribs. Portions of the first and second outer walls can have a thickness of less than about 0.018" (0.457 mm).

The dual wall component of the preceding paragraph can optionally include, additionally and/or alternatively, any one or more of the following features, configurations and/or additional components:

A further embodiment of the foregoing dual wall component can further include that the component is a blade extending from a root to a tip where the portions of the first outer wall and the second outer wall having thicknesses of less than about 0.018" (0.457 mm) are near the blade tip.

A further embodiment of any of the foregoing dual wall components can further include that portions of the first and second outer walls near the root have thicknesses of less than about 0.050" (1.27 mm).

A further embodiment of any of the foregoing dual wall components can further include that the first and second outer walls and the first and second inner walls are made up of a directionally solidified material.

A further embodiment of any of the foregoing dual wall components can further include that the first and second outer walls and the first and second inner walls are made up of an equiaxed material.

A further embodiment of any of the foregoing dual wall components can further include that the component is a vane.

A further embodiment of any of the foregoing dual wall components can further include that the component is a blade outer air seal.

A method for forming a dual wall component can include forming an outer wall, forming an inner wall where the inner wall and the outer wall are separated by a first cavity, and forming a third wall where the third wall and the inner wall are separated by a second cavity. The outer wall, the inner wall and the third wall can be formed by additive manufacturing and without using cores to form the first and second cavities.

A further embodiment of the foregoing method can further include forming a second outer wall where the second outer wall and the third wall are separated by a third cavity. The second outer wall can be formed by additive manufacturing and without using a core to form the third cavity.

A further embodiment of any of the foregoing methods can further include forming at least one rib between the outer wall and the inner wall.

A further embodiment of any of the foregoing methods can further include forming at least one rib between the inner wall and the third wall.

A further embodiment of any of the foregoing methods can further include forming at least one rib between the third wall and the second outer wall.

A further embodiment of any of the foregoing methods can further include that the outer wall, the inner wall and the third wall are formed using direct metal laser sintering.

A further embodiment of any of the foregoing methods can further include that the outer wall, the inner wall and the third wall are formed using electron beam melting.

A further embodiment of any of the foregoing methods can further include that the dual wall component is a blade comprising a root and a tip.

A further embodiment of any of the foregoing methods can further include that the additive manufacturing progresses from root to tip.

A further embodiment of any of the foregoing methods can further include that the additive manufacturing provides an opening that extends through at least one of the outer wall, the inner wall and the third wall.

A further embodiment of any of the foregoing methods can further include drilling an opening in the outer wall.

A method for forming a blade extending from a root to a tip can include forming a pressure side outer wall extending from a leading edge to a trailing edge, forming a suction side outer wall extending from the leading edge to the trailing edge, forming a first inner wall having a shape complimentary to the pressure side outer wall where the first inner wall and the pressure side outer wall are separated by a first cavity, and forming a second inner wall having a shape complimentary to the suction side outer wall where the second inner wall and the suction side outer wall are separated by a second cavity and where the second inner wall and the first inner wall are separated by a third cavity. The pressure side outer wall, the suction side outer wall, the first inner wall and the second inner wall can be formed by additive manufacturing and without using cores to form the first, second and third cavities.

A further embodiment of the foregoing method can further include that at a region near the tip, the pressure side outer wall and the suction side outer wall have thicknesses less than about 0.018" (0.457 mm) and where, at a region near the root, the pressure side outer wall and the suction side outer wall have thicknesses less than about 0.050" (1.27 mm).

Although the present invention has been described with reference to preferred embodiments, workers skilled in the art will recognize that changes may be made in form and detail without departing from the spirit and scope of the invention.

The invention claimed is:

1. A method for forming a blade extending along a radial axis from a root to a tip, the method comprising:

forming a pressure side outer wall extending from a leading edge to a trailing edge;

forming a suction side outer wall extending from the leading edge to the trailing edge;

forming a first inner wall integral to and having a shape complimentary to the pressure side outer wall, wherein the first inner wall and the pressure side outer wall are separated by a first cavity; and forming a second inner wall integral to and having a shape complimentary to the suction side outer wall, wherein the second inner wall and the suction side outer wall are separated by a second cavity, and wherein the second inner wall and the first inner wall are separated by a third cavity;

wherein each of the pressure and suction side outer walls, and the first and second inner walls includes a first thickness portion at a first radial position along the radial axis, and a second thickness portion at a second radial position along the radial axis, the second thickness portion being greater than the first thickness portion; and wherein the pressure side outer wall, the suction side outer wall, the first inner wall and the second inner wall are formed by additive manufacturing and without using cores to form the first, second and third cavities.

2. The method of claim 1, wherein, at the first radial position, the pressure side outer wall and the suction side outer wall have thicknesses less than 0.018" (0.457 mm), and wherein, at the second radial position, the pressure side outer wall and the suction side outer wall have thicknesses between 0.040" (1.02 mm) and 0.050" (1.27 mm).

3. A dual wall component extending along a radial axis, the component comprising:

a first outer wall extending from a leading edge to a trailing edge;

a first inner wall integrally formed with the first outer wall and spaced from the first outer wall by a plurality of first cavities and first ribs;

a second inner wall spaced from the first inner wall by a plurality of second cavities and second ribs; and a second outer wall extending from the leading edge to the trailing edge integrally formed with the second inner wall, and spaced from the second inner wall by a plurality of third cavities and third ribs;

wherein each of the first and second outer walls, and the first and second inner walls includes a first thickness portion at a first radial position along the radial axis, the first thickness portion being less than 0.018" (0.457 mm); and wherein each of the first and second outer walls, and the first and second inner walls includes a second thickness portion at a second radial position along the radial axis, the second thickness portion being between 0.040" (1.02 mm) and 0.050" (1.27 mm).

4. The dual wall component of claim 3, wherein the component is a blade extending radially from a root to a tip, and wherein the first radial position of the first thickness portion is nearer the blade tip than is the second radial position of the second thickness portion.

5. The dual wall component of claim 4, wherein the second radial position of the second thickness portion is nearer the root than is the first radial position of the first thickness portion.

6. The dual wall component of claim 3, wherein the first and second outer walls and the first and second inner walls comprise a directionally solidified material.

7. The dual wall component of claim 3, wherein the first and second outer walls and the first and second inner walls comprise an equiaxed material.

8. The dual wall component of claim 3, wherein the component is a vane.

9. The dual wall component of claim 3, wherein the component is a blade outer air seal.

10. A method for forming a dual wall component extending along a radial axis, the method comprising:

forming an outer wall;

forming an inner wall integral to the outer wall, wherein the inner wall and the outer wall are separated by a first cavity; and forming a third wall, wherein the third wall and the inner wall are separated by a second cavity, and wherein the outer wall, the inner wall and the third wall are formed by additive manufacturing and without using cores to form the first and second cavities;

wherein forming each of the outer wall, the inner wall, and the third wall comprises forming, at a first radial position, a first thickness portion, and forming, at a second radial position, a second thickness portion, the second thickness portion being greater than the first thickness portion.

11. The method of claim 10, further comprising:

forming a second outer wall, wherein the second outer wall and the third wall are separated by a third cavity, and wherein the second outer wall is formed by additive manufacturing and without using a core to form the third cavity.

12. The method of claim 11, further comprising:

forming at least one rib between the third wall and the second outer wall.

13. The method of claim 10, wherein the dual wall component is a blade comprising a root and a tip.

14. The method of claim 13, wherein the additive manufacturing progresses from root to tip.

15. The method of claim 10, further comprising:

forming at least one rib between the outer wall and the inner wall.

16. The method of claim 10, further comprising:

forming at least one rib between the inner wall and the third wall.

17. The method of claim 10, wherein forming the outer wall, forming the inner wall and forming the third wall are performed using direct metal laser sintering.

18. The method of claim 10, wherein forming the outer wall, forming the inner wall and forming the third wall are performed using electron beam melting.

19. The method of claim 10, wherein the additive manufacturing provides an opening that extends through at least one of the outer wall, the inner wall and the third wall.

20. The method of claim 10, further comprising:

drilling an opening in the outer wall.

* * * * *